United States Patent [19]

Di Costanzo et al.

[11] 4,287,645

[45] Sep. 8, 1981

[54] WAIST BAND FOR PANTS

[76] Inventors: Pasquale F. Di Costanzo; George Spector, both of 3615 Woolworth Bldg., 233 Broadway, New York, N.Y. 10007

[21] Appl. No.: 101,681

[22] Filed: Dec. 10, 1979

[51] Int. Cl.[3] ..... A44B 9/10; A44B 9/00

[52] U.S. Cl. ..... 24/301; 24/357; 24/380

[58] Field of Search ..... 24/87 R, 87 TB, 87 C, 24/150 R

[56] References Cited

U.S. PATENT DOCUMENTS 1,638,921 8/1927 Cummings ..... 24/87 TB 2,308,336 1/1943 Mason ..... 24/87 TB 3,321,775 5/1967 Berlin ..... 24/87 TB

FOREIGN PATENT DOCUMENTS 673380 11/1963 Canada ..... 24/87 TB

*Primary Examiner*—Roy D. Frazier

*Assistant Examiner*—Alexander Grosz

[57] ABSTRACT

A band for taking up excessive waistline material of an oversized pair of slacks having no belt; the band including a short length of elastic tape having a row of parallel pins at each end thereof, the pointed ends of each row of pins pointing toward each other and a comb-like flexible plastic pad adjacent each pin row protecting a person from being stuck by the pin points.

2 Claims, 7 Drawing Figures

Fig. 1
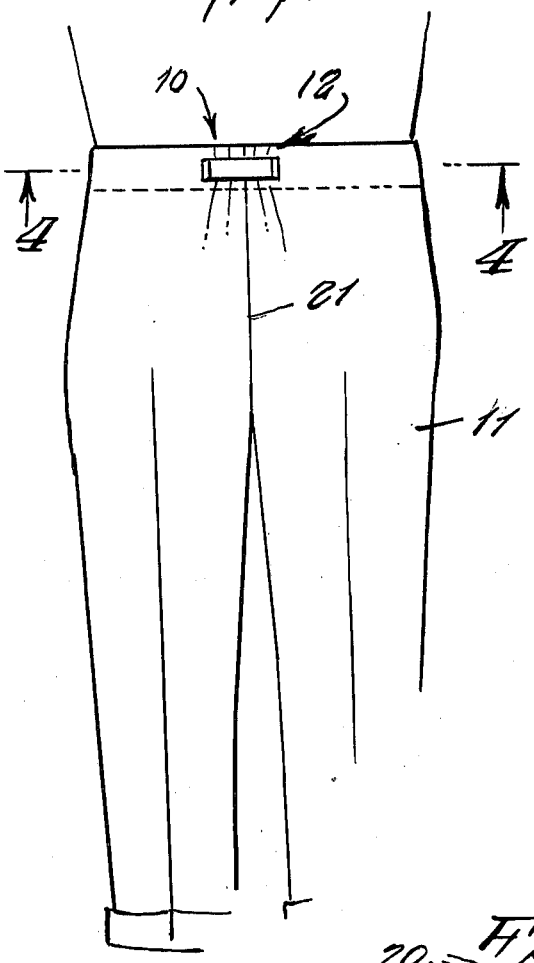
Fig. 2
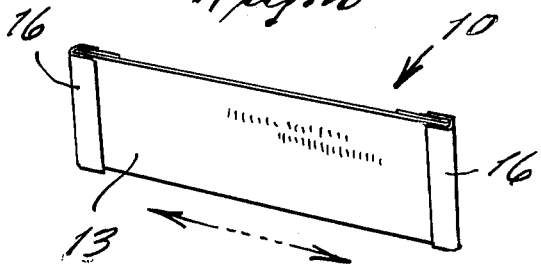
Fig. 3
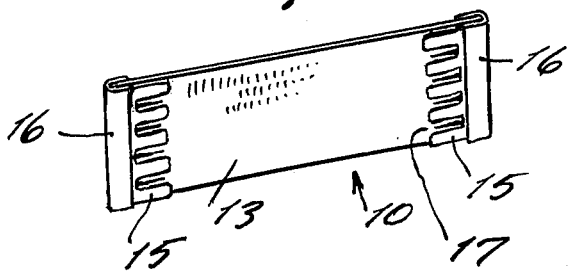
Fig. 4
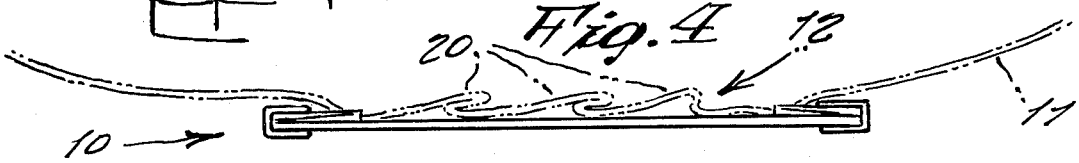
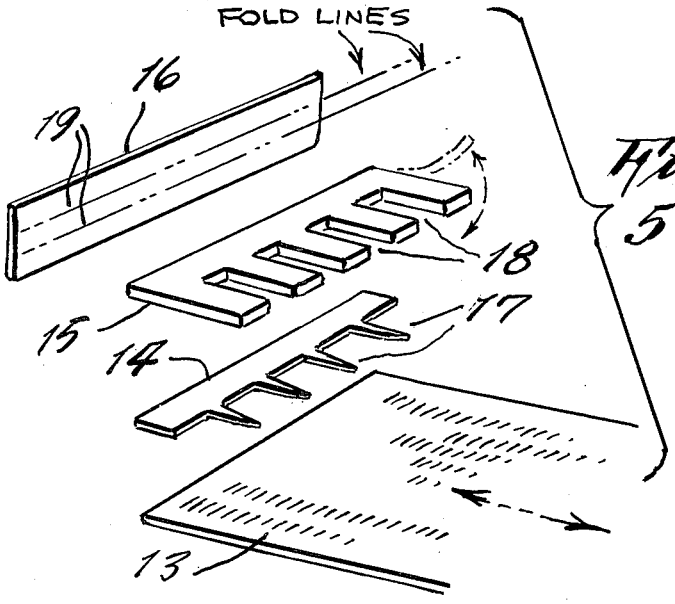
Fig. 5
Fig. 6
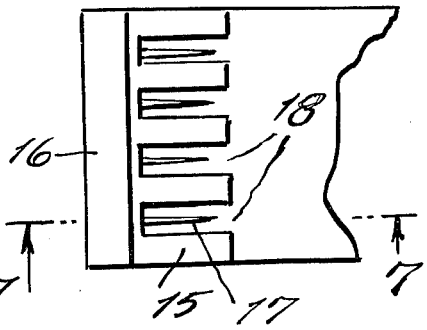
Fig. 7
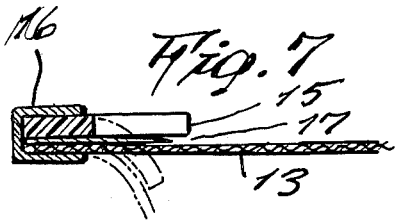

WAIST BAND FOR PANTS

This invention relates generally to garment accessories. More specifically it relates to belt devices.

It is well known that sometimes a person's waistline reduces a fraction of an inch, particularly these days when persons watch their weight against gaining. Thus, clothing may become slightly oversized. While many garments are not much affected by small changes, a beltless pair of slacks may become too loose to hold up by a smaller waistline. This situation is accordingly in need of a solution.

Therefore it is a principal object of the present invention to provide a beltless belt designed to take up a waistline excess of a pair of slacks.

Another object is to provide a beltless belt which can be quickly and easily installed or removed, is adjustable and is thoroughly comfortable and good looking.

In the drawing:

FIG. 1 is a front view of a pair of pants, and showing the invention attached thereupon.

FIG. 2 is an enlarged front perspective view of the invention.

FIG. 3 is a rear perspective view thereof.

FIG. 4 is an enlarged cross sectional view on line 4—4 of FIG. 1.

FIG. 5 is an exploded view of components of the invention.

FIG. 6 is a fragmentary rear view of the device shown enlarged.

FIG. 7 is a further enlarged cross sectional view taken on line 7—7 of FIG. 6, and showing how a flexible plastic comb-like pad protects the pin points from being exposed in order to prevent sticking a person; the dotted lines showing how the pad and elastic are flexed out of the way when the pins are applied on the pants.

Referring now to the drawing in greater detail, the reference numeral 10 represents a beltless belt according to the present invention and which is readily attachable to a pair of beltless slacks 11 so to take up excessive waistline material 12.

The beltless belt includes an elastic tape 13 which at opposite ends has a toothed metal plate 14 and a flexible plastic, comb-like pad 15 securely clamped thereto by means of a folded over, sheet metal clip 16 that folds around an end edge of the tape the plate and the pad aligned together.

The metal plate is made of a flat hardened steel and includes a row of parallel, equally spaced apart tapering teeth 17 or pins formed upon as opposite edge; the teeth being made either of equal or dissimilar lengths as preferred by a manufacturer.

The pad includes a plurality of equally spaced apart notches 18 along an opposite edge, the notches aligning with the teeth, so that the teeth are thus exposed within the notches. The pad is relatively thicker than the plate 14.

In assembling each opposite end of the beltless belt 10, the plate is positioned between the tape and the pad with end edges thereof all being aligned, after which the sheet metal clamp is folded around the fold liner 19 so to form a U-shaped appearance around the aligned edges and is then firmly pressed so to clamp the structure together.

The beltless belt, thus constructed is then applied to a waist of the slacks is shown in FIG. 1, with the excessive slack material being gathered between the two rows of teeth, the excess material being spread apart so to form pleats 20. Preferably, as shown the beltless belt should be applied across a central seam 21 of the slacks so that it produces a harmonious appearance when worn. The tape may be made of a color that harmonizes with the color of the slack.

As clearly shown is FIG. 7, when applying the device to the slacks, the tape and pad are bent over as shown by the dotted lines in order to expose the pointed ends of the teeth so that they may be inserted into the slack fabric. After thus attached and the tape and pad are straightened, as shown by the solid lines in the figure, the pointed ends of the teeth are thus sheltered within the notches 18 so that a wearer cannot be stuck thereby; the slack fabric flexing into the notches when engaging the teeth.

What is claimed as new, is:

1. A beltless belt, comprising in combination, a length of elastic tape, a metal plate at each end of said tape having a row of pointed teeth, said teeth of each said plate pointing toward each other, wherein a flexible plastic pad is included at each said tape end, said pad having a row of notches along one side aligning with said row of teeth.

2. The combination as in claim 1, wherein said plate is positioned between said tape and said pad; and a U-shaped clamp holding said tape, said plate and said pad together.

* * * * *